US008904802B2

(12) United States Patent
Kodukulla et al.

(10) Patent No.: US 8,904,802 B2
(45) Date of Patent: Dec. 9, 2014

(54) TURBOMACHINE COMBUSTOR ASSEMBLY INCLUDING A VORTEX MODIFICATION SYSTEM

(75) Inventors: Sridhar Venkat Kodukulla, Karnataka (IN); Ronald James Chila, Greer, SC (US); Sarah Lori Crothers, Greenville, SC (US); Shreekrishna Jayakumar Rao, Atlanta, GA (US); Shivakumar Srinivasan, Greer, SC (US)

(73) Assignee: General Electric Company, Schenectady, NY (US)

( * ) Notice: Subject to any disclaimer, the term of this patent is extended or adjusted under 35 U.S.C. 154(b) by 776 days.

(21) Appl. No.: 13/173,951

(22) Filed: Jun. 30, 2011

(65) Prior Publication Data

US 2013/0000312 A1 Jan. 3, 2013

(51) Int. Cl.

| | |
|---|---|
| ***F02C 1/00*** | (2006.01) |
| ***F23R 3/00*** | (2006.01) |
| ***F23R 3/06*** | (2006.01) |
| ***F23R 3/16*** | (2006.01) |

(52) U.S. Cl.

CPC ..... *F23R 3/005* (2013.01); *F23M 99/005* (2013.01); *F23R 3/06* (2013.01); *F23R 3/16* (2013.01); *F23R 2900/03044* (2013.01); *F23R 2900/03045* (2013.01)

USPC ..... 60/772; 60/752; 60/755; 60/757; 60/760

(58) Field of Classification Search

CPC ..... F23R 3/002; F23R 3/04; F23R 3/045; F23R 3/06; F23R 3/16; F23R 2900/03044; F23R 2900/03045

USPC ..... 60/752–760, 772, 804

See application file for complete search history.

(56) References Cited

U.S. PATENT DOCUMENTS

| | | | | |
|---|---|---|---|---|
| 5,598,697 | A * | 2/1997 | Ambrogi et al. | 60/782 |
| 5,857,323 | A * | 1/1999 | Beveridge et al. | 60/258 |
| 6,238,183 | B1 * | 5/2001 | Williamson et al. | 416/96 A |
| 6,427,446 | B1 * | 8/2002 | Kraft et al. | 60/737 |
| 6,430,932 | B1 * | 8/2002 | Martling et al. | 60/760 |
| 6,446,438 | B1 | 9/2002 | Kraft et al. | |
| 6,530,221 | B1 | 3/2003 | Sattinger et al. | |
| 6,688,110 | B2 * | 2/2004 | Dailey et al. | 60/752 |
| 6,772,595 | B2 * | 8/2004 | Martling et al. | 60/737 |
| 6,964,170 | B2 * | 11/2005 | Alkabie | 60/772 |
| 7,194,862 | B2 | 3/2007 | Sattinger | |
| 7,270,175 | B2 * | 9/2007 | Mayer et al. | 165/47 |
| 7,370,645 | B2 * | 5/2008 | Freeman et al. | 123/574 |
| 2006/0260291 | A1 * | 11/2006 | Vandervort et al. | 60/39.76 |
| 2007/0245742 | A1 * | 10/2007 | Dahlke et al. | 60/754 |
| 2009/0053054 | A1 * | 2/2009 | Grooms et al. | 415/208.1 |
| 2011/0214428 | A1 * | 9/2011 | Shershnyov et al. | 60/754 |

* cited by examiner

*Primary Examiner* — Ehud Gartenberg
*Assistant Examiner* — Lorne Meade
(74) *Attorney, Agent, or Firm* — Cantor Colburn LLP

(57) ABSTRACT

A turbomachine combustor assembly includes a combustor body, and a combustor liner arranged within the combustor body and defining a combustion chamber. The combustor liner includes a venturi portion arranged within the combustion chamber. A fluid passage is defined between the combustor body and the combustor liner, and at least one turbulator is arranged in the fluid passage. The at least one turbulator is configured and disposed to create vortices in the fluid passage. A vortex modification system is arranged at the fluid passage and is configured and disposed to disrupt the vortices in the fluid passage.

17 Claims, 5 Drawing Sheets

TURBOMACHINE COMBUSTOR ASSEMBLY INCLUDING A VORTEX MODIFICATION SYSTEM

BACKGROUND OF THE INVENTION

The subject matter disclosed herein relates to the art of turbomachines and, more particularly, to a turbomachine combustor including a vortex modification system.

In general, gas turbine engines combust a fuel/air mixture that releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications, such as for providing power to a pump or an electrical generator.

Many gas turbines include an annular combustor within which are formed the combustion gases that create the high temperature gas stream. Other turbomachines employ a plurality of combustors arranged in a can-annular array. In such a turbomachine, the combustion gases are formed in each of the plurality of combustors, combusted in a combustion chamber defined by a combustor body, and delivered to the turbine through a transition piece. Often times, compressor discharge air is passed into the combustor to cool various surfaces and aid in forming the fuel/air mixture. In certain arrangements, compressor discharge air is often channeled along a combustor liner toward a venturi.

A portion of the compressor discharge air is directed onto internal surfaces of the venturi for cooling. The compressor discharge air passes from the venturi into a passage formed between the combustor body and the combustor liner. In certain arrangements, a plurality of turbulator members is arranged in the passage. The turbulator members create flow vortices that enhance heat transfer in the combustor body. The compressor discharge air exits the passage into the combustion chamber to mix with the combustion gases.

BRIEF DESCRIPTION OF THE INVENTION

According to one aspect of the exemplary embodiment, a turbomachine combustor assembly includes a combustor body, and a combustor liner arranged within the combustor body and defining a combustion chamber. The combustor liner includes a venturi portion arranged within the combustion chamber. A fluid passage is defined between the combustor body and the combustor liner, and at least one turbulator is arranged in the fluid passage. The at least one turbulator is configured and disposed to create vortices in the fluid passage. A vortex modification system is arranged at the fluid passage and is configured and disposed to disrupt the vortices.

According to another aspect of the exemplary embodiment a turbomachine includes a compressor portion, a turbine portion, and a combustor assembly fluidly connecting the compressor portion and the turbine portion. The combustor assembly includes a combustor body, and a combustor liner arranged within the combustor body and defining a combustion chamber. The combustor liner includes a venturi portion arranged within the combustion chamber. A fluid passage is defined between the combustor body and the combustor liner, and at least one turbulator is arranged in the fluid passage. The at least one turbulator is configured and disposed to create vortices in the fluid passage. A vortex modification system is arranged at the fluid passage and is configured and disposed to disrupt the vortices.

According to yet another aspect of the exemplary embodiment, a method of mitigating undesirable noise in a combustor assembly with compressor discharge air includes passing compressor discharge air into a venturi portion arranged within the combustor assembly, guiding the compressor discharge air across interior surfaces of the venturi portion to provide cooling, passing the compressor discharge air from the venturi portion into a fluid passage defined in the combustor assembly, creating vortices in the compressor discharge air passing through the fluid passage to facilitate heat exchange, and disrupting the vortices in the compressor discharge air to minimize undesirable noise in the combustor assembly.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
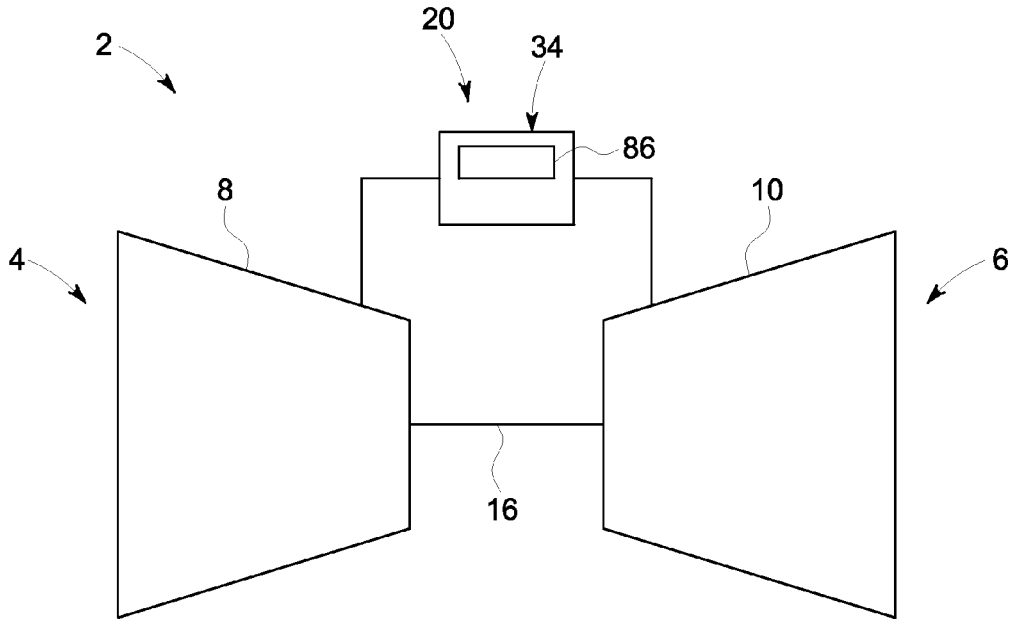
FIG. 1 is a schematic view of a turbomachine including a combustor assembly having a vortex modification system in accordance with an exemplary embodiment.

With reference to FIG. 1, a turbomachine constructed in accordance with an exemplary embodiment is indicated generally at 2. Turbomachine 2 includes a compressor portion 4 and a turbine portion 6. Compressor portion 4 includes a compressor housing 8 and turbine portion 6 includes a turbine housing 10. Compressor portion 4 is linked to turbine portion 6 through a common compressor/turbine shaft or rotor 16. Compressor portion 4 is also linked to turbine portion 6 through a plurality of circumferentially spaced combustor assemblies, one of which is indicated at 20.

Figure 2:
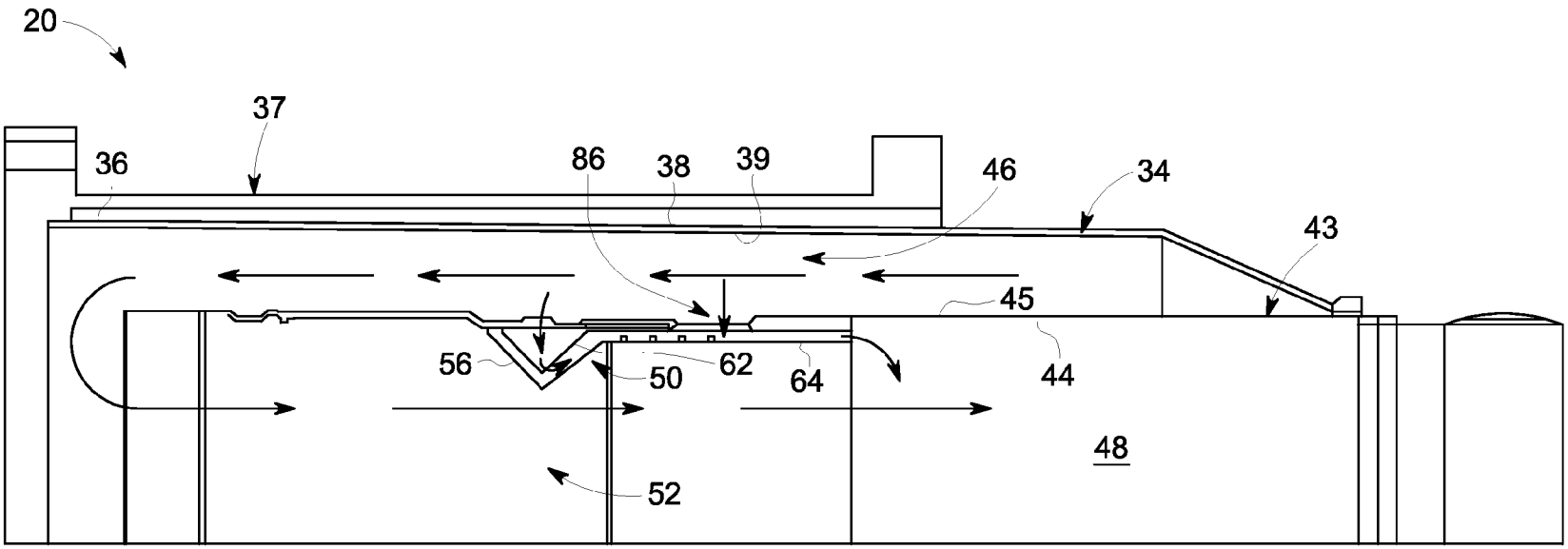
FIG. 2 is a partial cross-sectional side view of the combustor assembly of FIG. 1 illustrating a vortex modification system in accordance with one aspect of the exemplary embodiment.

As best shown in FIG. 2, combustor assembly 20 includes a combustor body 34 having a forward end 36 to which is mounted an injector nozzle housing 37. Combustor body 34 includes an outer surface 38 and an inner surface 39. In the exemplary embodiment shown, combustor assembly 20 includes a combustor liner 43 arranged within combustor body 34. Combustor liner 43 includes an inner surface 44 and an outer surface 45. Outer surface 45 is spaced from an inner surface 39 forming a passage 46 that transmits compressor discharge air from compressor portion 4 toward injector nozzle housing 37. Inner surface 44 of combustor liner 43 defines a combustion chamber 48. In further accordance with the exemplary embodiment shown, combustor assembly 20 includes a venturi portion 50 provided on combustor liner 43 in combustion chamber 48. Venturi portion 50 defines a venturi throat 52 that operates to stabilize a combustible mixture passing through combustion chamber 48.

Figure 3:
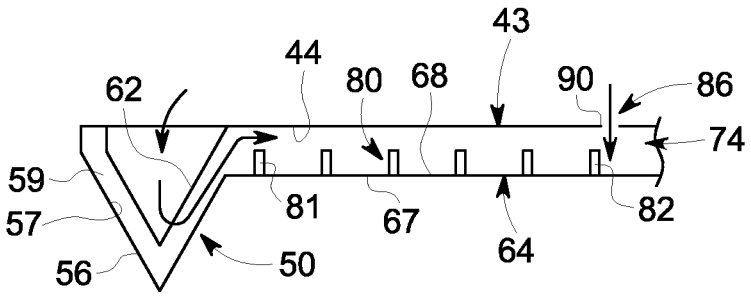
FIG. 3 is a detail view of the vortex modification system of FIG. 2 showing a jet member positioned adjacent a downstream end turbulator.

In the exemplary embodiment shown in FIGS. 2 and 3, venturi portion 50 includes an outer surface 56 that is exposed to combustion gases in combustion chamber 48 and an inner surface 57 that defines an inner venturi section 59. Venturi portion 50 is also shown to include an inner venturi plate 62 arranged within inner venturi section 59 and a venturi wall 64 that extends downstream in combustion chamber 48. Venturi wall 64 includes an outer surface 67 and an inner surface 68. Inner surface 68 of venturi wall 64 is spaced from inner surface 44 of combustor liner 43 forming a fluid passage 74. With this arrangement, inner venturi plate 62 directs a portion of the compressor discharge air passing through passage 46 onto inner surface 57 of venturi portion 50. The portion of compressor discharge air passes over inner surface 57 to provide cooling at venturi portion 50 before passing into fluid passage 74 and discharging into combustion chamber 48.

As further shown in the exemplary embodiment, a plurality of turbulators 80 is arranged on venturi wall 64. Turbulators 80 extend between an upstream end turbulator 81 and a downstream end turbulator 82. Turbulators 80 create vortices in the portion of compressor discharge air passing through fluid passage 74. The vortices enhance heat transfer between venturi wall 64 and combustor liner 43. However, the vortices have been shown to create undesirable high frequency noise in combustor assembly 20. In order to mitigate the undesirable noise, combustor assembly 20 includes a vortex modification system 86. In accordance with the exemplary aspect shown, vortex modification system 86 includes a jet member 90 formed in combustor liner 43 and positioned downstream from downstream end turbulator 82. Jet member 90 directs a stream of fluid at the portion of combustor discharge air passing through fluid passage 74. The fluid passing from jet member 90 disrupts the vortices imparted to the portion of combustor discharge air created by turbulators 80 to mitigate undesirable noise in combustor assembly 20.

Figure 4:
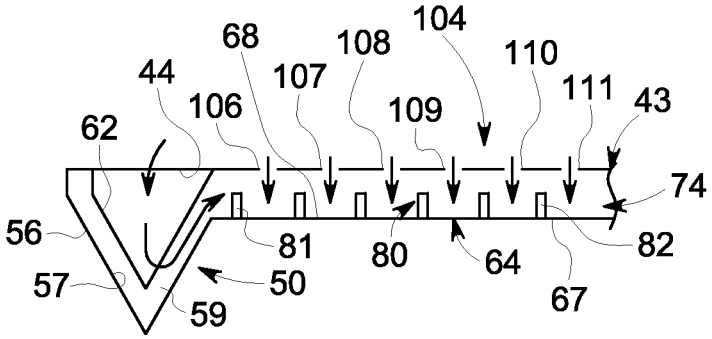
FIG. 4 is a detail view of a vortex modification system in accordance with another aspect of the exemplary embodiment illustrating a jet member positioned between adjacent ones of a plurality of turbulators.
Figure 5:
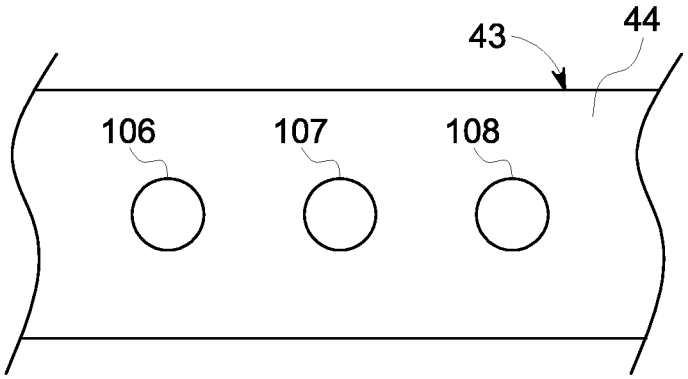
FIG. 5 depicts jet members in accordance with one aspect of the exemplary embodiment.
Figure 6:
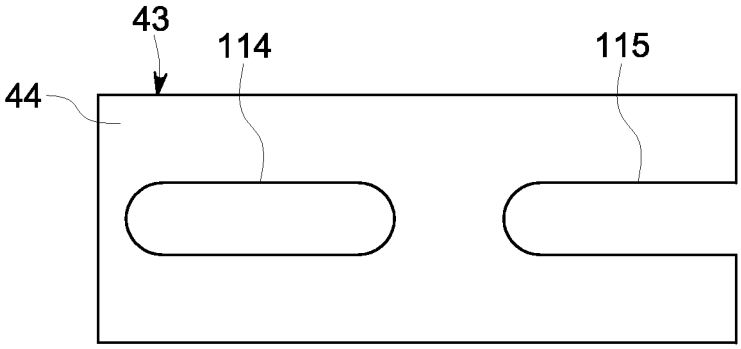
FIG. 6 depicts jet members in accordance with another aspect of the exemplary embodiment.
Figure 7:
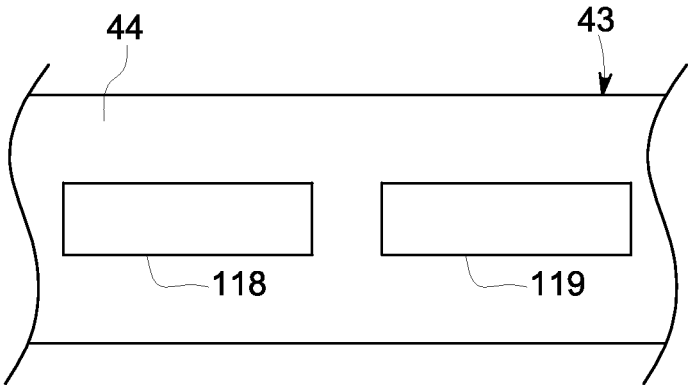
FIG. 7 depicts jet members in accordance with yet another aspect of the exemplary embodiment.

Reference will now be made to FIG. 4, wherein like reference numbers represent corresponding parts in the respective views, in describing a vortex modification system 104 in accordance with another aspect of the exemplary embodiment. Vortex modification system 104 includes a plurality of jet members 106-111 formed in combustor liner 43. As best shown in FIG. 5, jet members 106-111 have a circular cross-section. Jet members 106-111 are positioned between adjacent ones of turbulators 80. With this arrangement, jet members 106-111 disrupt the vortices created at each turbulator 80. The disruption of the vortices does not interfere with heat transfer properties but does mitigate undesirable noise in combustor assembly 20. Actually, it has been found that the disruption of the vortices may enhance heat transfer characteristics of the portion of compressor discharge air passing through fluid passage 74. At this point it should be understood that jet members can take on a variety of forms. For example, FIG. 6 illustrates jet members 114 and 115 having non-circular or an oval shaped cross section. FIG. 7 illustrates jet members 118 and 119 having non-circular or rectangular cross-section. The particular shape of jet members 106-111 is not limited to those examples shown. It should be understood that jet member 90 could also take on a variety of forms.

Figure 8:
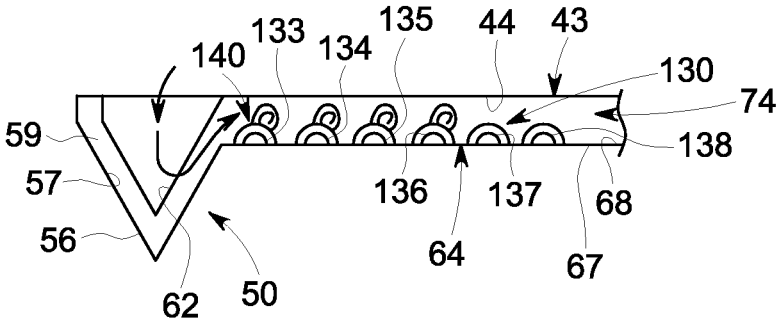
FIG. 8 illustrates a vortex modification system in accordance with another aspect of the exemplary embodiment.

Reference will now be made to FIG. 8, wherein like reference numbers represent corresponding parts in the respective views, in describing a vortex modification system 130 in accordance with yet another aspect of the exemplary embodiment. Vortex modification system 130 takes the form of vortex modifying turbulators 133-138. Vortex modifying turbulators 133-138 include a rounded end portion, such as shown at 140 on vortex modifying turbulator 133, that disrupts vortices created in fluid passage 74. The shape and number of vortex modifying turbulators can vary. For example, in accordance with the exemplary aspect shown, fluid passage 74 may include as few as one vortex modifying turbulator or all turbulators may be modified to create vortices that do not promote the creation of undesirable noise in combustor assembly 20 while also ensuring a desired heat transfer from venturi wall 64 to combustor liner 43.

Figure 9:
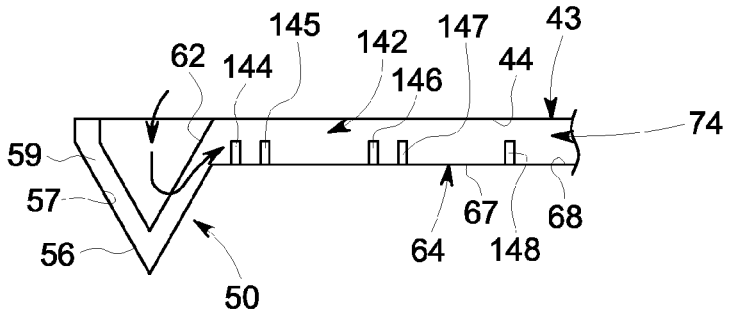
FIG. 9 illustrates a vortex modification system in accordance with still another aspect of the exemplary embodiment.

Reference will now be made to FIG. 9, wherein like reference numbers represent corresponding parts in the respective views, in describing a vortex modification system 142 in accordance with still another aspect of the exemplary embodiment. Vortex modification system 142 includes a plurality of turbulators 144-148 arranged on inner surface 68 of venturi wall 64. In the exemplary embodiment shown, vortex modification is achieved by varying a spacing between adjacent ones of turbulators 144-148. For example, spacing between turbulators 144 and 145 is different from a spacing between turbulators 145 and 146. The variation in spacing disrupts vortices created in fluid passage 74 to mitigate the creation of undesirable noise in combustor assembly 20 while also ensuring a desired heat transfer from venturi wall 64 to combustor liner 43.

Figure 10:
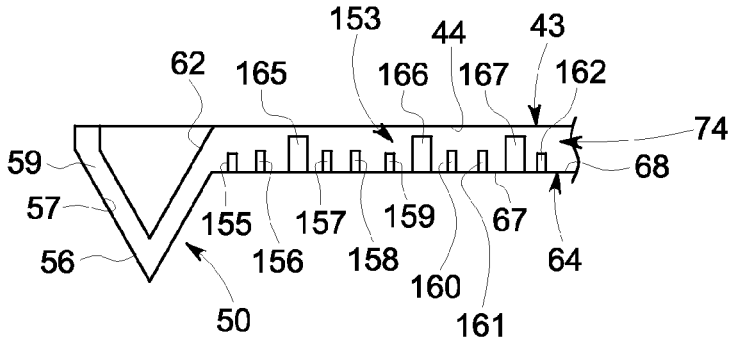
FIG. 10 illustrates a vortex modification system in accordance with yet another aspect of the exemplary embodiment.

Reference will now be made to FIG. 10, wherein like reference numbers represent corresponding parts in the respective views, in describing a vortex modification system 153 in accordance with still another aspect of the exemplary embodiment. Vortex modification system 153 includes a first plurality of turbulators 155-162, and a second plurality of turbulators 165-167 mounted to inner surface 68 of venturi wall 64. The first plurality of turbulators 155-162 is configured to create a first plurality of vortices in fluid passage 74. The second plurality of turbulators 165-167 have a height relative to inner surface 68 that is distinct from a height of first plurality of turbulators 155-162. In the exemplary embodiment shown, second plurality of turbulators 165-167 have a height relative to inner surface 68 that is greater than the height of first plurality of turbulators 155-162. In this manner, first plurality of turbulators 155-162 constitute vortex modifying turbulators that are configured to create a second plurality of vortices in fluid passage 74. The second plurality of vortices are configured to disrupt the first plurality of vortices in order to mitigate the creation of undesirable noise in combustor 20 while also ensuring a desired heat transfer from venturi wall 64 to combustor liner 43.

Figure 11:
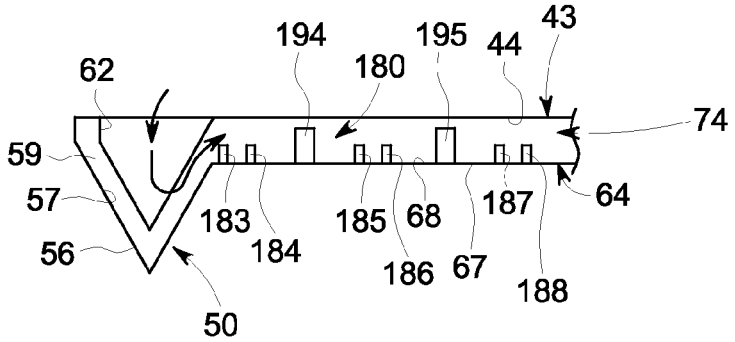
FIG. 11 illustrates a vortex modification system in accordance with still yet another aspect of the exemplary embodiment.

Reference will now be made to FIG. 11, wherein like reference numbers represent corresponding parts in the respective views, in describing a vortex modification system 180 in accordance with still another aspect of the exemplary embodiment. Vortex modification system 180 includes a first plurality of turbulators 183-188 and a second plurality of turbulators 194-195 mounted to inner surface 68 of venturi wall 64. The first plurality of turbulators 183-188 are configured to create a first plurality of vortices in fluid passage 74. The second plurality of turbulators 194-195 have a height relative to inner surface 68 that is distinct from a height of first plurality of turbulators 183-188 and thus constitute vortex modifying turbulators. In the exemplary embodiment shown, second plurality of turbulators 194-195 have a height relative to inner surface 68 that is greater than the height of first plurality of turbulators 183-188. In this manner, first plurality of turbulators 183-188 constitute vortex modifying turbulators that are configured to create a second plurality of vortices in fluid passage 74.

In addition, a spacing between the first plurality of turbulators 183-188 and the second plurality of turbulators 194-195 is varied to further disrupt vortices in fluid passage 74. Of course it should be understood that spacing between adjacent ones of the first plurality of turbulators 183-188 and/or between adjacent ones of the second plurality of turbulators could also vary. The second plurality of turbulators along with the varied spacing between turbulators collectively operate to disrupt the first plurality of vortices in order to mitigate the creation of undesirable noise in combustor 20 while also ensuring a desired heat transfer from venturi wall 64 to combustor liner 43.

At this point it should be understood that the exemplary embodiment provides a system that not only generates vortices in a combustor fluid passage to enhance heat transfer, but also a system for disrupting those vortices to mitigate noise in the combustor. It should also be understood that the number of turbulators could vary. It should be further recognized that the number, size and shape of vortex modifying turbulators could also vary.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine combustor assembly comprising:

a combustor body;

a combustor liner arranged within the combustor body and defining a combustion chamber, the combustor liner including a venturi portion arranged within the combustion chamber;

a fluid passage defined between the venturi portion and the combustor liner;

a plurality of turbulators arranged in the fluid passage, the plurality of turbulators being configured and disposed to create vortices in the fluid passage; and a vortex modification system arranged at the fluid passage, the vortex modification system including at least one jet member arranged to deliver a flow of fluid into the fluid passage downstream of a downstream end turbulator of the plurality of turbulators and being configured and disposed to disrupt the vortices in the fluid passage and mitigate undesirable noise in the combustor assembly.

2. The turbomachine combustor assembly according to claim 1, wherein the at least one jet member includes a plurality of jet members arranged between adjacent ones of the plurality of turbulators.

3. The turbomachine combustor assembly according to claim 1, wherein the at least one jet member includes a circular cross-section.

4. The turbomachine combustor assembly according to claim 1, wherein the at least one jet member includes a non-circular cross-section.

5. The turbomachine combustor assembly according to claim 1, wherein the vortex modification system includes at least one vortex modifying turbulator arranged adjacent to at least one of the plurality of turbulators.

6. The turbomachine combustor assembly according to claim 5, wherein the at least one vortex modifying turbulator includes a dimension that is greater than a dimension of the at least one turbulator.

7. The turbomachine combustor assembly according to claim 5, wherein the at least one vortex modifying turbulator includes a rounded end portion.

8. The turbomachine combustor assembly according to claim 5, wherein the vortex modification system comprises forming each of the plurality of turbulators with a rounded end portion.

9. The turbomachine combustor assembly according to claim 1, wherein the vortex modification system comprises a varied spacing between adjacent ones of the plurality of turbulators.

10. The turbomachine combustor assembly according to claim 1, wherein the vortex modification system includes at least one vortex modifying turbulator arranged adjacent to one or more of the plurality of turbulators and a varied spacing between adjacent ones of the plurality of turbulators.

11. A turbomachine comprising:

a compressor portion;

a turbine portion; and a combustor assembly fluidly connecting the compressor portion and the turbine portion, the combustor assembly including:

a combustor body;

a combustor liner arranged within the combustor body and defining a combustion chamber, the combustor liner including a venturi portion arranged within the combustion chamber;

a fluid passage defined between the venturi portion and the combustor liner;

a plurality of turbulators arranged in the fluid passage, the plurality of turbulators being configured and disposed to create flow vortices in the fluid passage; and a vortex modification system arranged at the fluid passage, the vortex modification system including at least one jet member arranged to deliver a flow of fluid into the fluid passage downstream of a downstream end turbulator of the plurality of turbulators to disrupt the vortices in the fluid passage and mitigate undesirable noise in the combustor assembly.

12. The turbomachine according to claim 11, wherein the at least one jet member includes a plurality of jet members arranged between adjacent ones of the plurality of turbulators.

13. The turbomachine according to claim 11, wherein the vortex modification system includes at least one vortex modifying turbulator arranged adjacent to at least one of the plurality of turbulators.

14. The turbomachine according to claim 13, wherein the at least one vortex modifying turbulator includes a dimension that is greater than a dimension of the at least one turbulator.

15. The turbomachine according to claim 13, wherein the at least one vortex modifying turbulator includes a rounded end portion.

16. The turbomachine according to claim 11, wherein the vortex modification system includes at least one vortex modifying turbulator arranged adjacent to one or more of the plurality of turbulators and a varied spacing between adjacent ones of the plurality of turbulators.

17. A method of mitigating undesirable noise in a combustor assembly with compressor discharge air, the method comprising:

passing compressor discharge air into a venturi portion arranged within the combustor assembly;

guiding the compressor discharge air across interior surfaces of the venturi;

passing the compressor discharge air from the venturi portion into a fluid passage defined in the combustor assembly;

passing the compressor discharge air passing through the fluid passage across a plurality of turbulators creating vortices in the compressor discharge air passing through the fluid passage to facilitate heat exchange through an interaction with the plurality of turbulators; and disrupting the vortices in the compressor discharge air to reduce undesirable noise in the combustor assembly by introducing a fluid flow into the fluid passage downstream of a downstream end one of the plurality of turbulators mitigating undesirable noise in the combustor assembly.

* * * * *